United States Patent [19]

Pryor et al.

[11] 4,269,874

[45] May 26, 1981

[54] METHOD AND APPARATUS FOR MARKING PARTS

[75] Inventors: Timothy R. Pryor, Tecumseh; David M. Alway; Omer L. Hageniers, both of Windsor, all of Canada

[73] Assignee: Diffracto Ltd., Windsor, Canada

[21] Appl. No.: 64,866

[22] Filed: Aug. 8, 1979

[51] Int. Cl.[3] ..... B05D 1/32

[52] U.S. Cl. ..... 427/282; 101/127; 101/129; 118/301; 427/421

[58] Field of Search ..... 427/282, 421; 101/127, 101/129; 118/301

[56] References Cited

U.S. PATENT DOCUMENTS

| | | | |
|---|---|---|---|
| 2,622,990 | 12/1952 | Rinck et al. | 427/282 |
| 3,088,859 | 5/1963 | Smith | 427/282 |
| 3,927,230 | 12/1975 | MacDonald et al. | 427/282 |
| 4,066,807 | 1/1978 | Craig | 427/282 |

*Primary Examiner*—Ronald H. Smith
*Assistant Examiner*—Janyce A. Bell
*Attorney, Agent, or Firm*—Larson, Taylor and Hinds

[57] ABSTRACT

A spray of ink, paint, or other marking liquid is formed and sprayed through a stencil member for marking a part with a stencil character. Various means are provided to periodically move the stencil member for removal of marking fluid to keep the system clean. In one system, the stencil member is rotatable and marking fluid is removed periodically by centrifugal force by rotating the member at a sufficient speed. Removal of the marking fluid may be facilitated by the application of solvent or fresh marking fluid. In another embodiment, the stencil member is moved to a marking liquid removal location where the marking liquid is removed by suction, solvent action, and the like. The removed marking liquid may be collected by providing an absorbent member positioned to receive the removed liquid, or by providing collecting gutters or the like.

14 Claims, 7 Drawing Figures

METHOD AND APPARATUS FOR MARKING PARTS

BACKGROUND OF THE INVENTION

The present invention relates to methods and apparatus for marking parts.

In the manufacturing industries, the marking of parts has traditionally been a serious problem area. Parts are routinely marked in manufacturing such as automotive and other manufacturing industries to signify good versus bad parts, the part type, the shift on which it was made, etc. In the past, the marking used has primarily been ink or paint spray, or stamp markers, although recently there has been some limited use of high-speed ink jet printers. Also used are permanent marking units such as steel stamps, laser engravers, etc.

The ink (or paint) spray markers are perhaps the widest used, but they have traditionally suffered from several disadvantages. First, they are capable of only marking a code related to the color of the ink within the tank or for that matter just ink or no ink. In addition, these ink spray markers are notoriously messy and cause considerable difficulties in-plant. Over-spray goes everywhere on the automation equipment, on the parts, and on the machines, thus causing a maintenance problem.

The other type of ink/paint marker presently used is a stamp type which wets the end of a stamp wick and drives it into a part on command. These tend to be less messy, although by no means mess-free, but have the considerable disadvantage of clogging of the ink wetting process and the problems arising from contact with the part such as wear etc. Naturally, because of the contact, the part has to be more precisely stationed than would be required with a spray.

A problem common to both of the above types of ink markers is that when seldom used, they tend to clog and eventually cease functioning. This problem continually manifests itself when the marker is asked to mark only reject parts of which there are not too many on a given shift, etc.

Another disadvantage of the conventional markers is that only one spray head or ink head can be used for any given code. For example, to mark a part with one of four different possible indications of part quality, four different ink units or four different stamp heads are required. Besides being an expense, this is a maintenance problem, particularly when any one of those guns is rarely used as in the reject case above. Such rare use inevitably leads to clogging of the rarely used unit.

At the other end of the spectrum, the present art also includes high speed ink jet printers which can write any number of computer generated characters at very high rates of speed on moving parts. On the face of it, these would obviate, in many cases all of the detrements above. However, the ink jet printers are expensive, require special inks, special daily purging and cleaning routines and, in many cases, special electrical precautions to be taken in the environment. In short, they require more specialized maintenance which is often unavailable in manufacturing plants. The ink jet printers also require inks that are generally not presently available in light or pigmented colors, nor are they available in solvent types capable of cutting through oil films on parts. Thus, they often wash off or blur readily, which is generally undesirable. Moreover, ink jet printers by definition cannot spray paints.

It is an object of the present invention to provide methods and apparatus for marking objects which obviate the varying disadvantages of the present types described above. It is a further object to provide a simple non-contact ink spray based marker which, while low in cost, is capable of multiple different codes from the same gun.

BRIEF SUMMARY OF THE INVENTION

The foregoing and other objects which will be apparent to those of ordinary skill in the art are achieved in accordance with the present invention by providing a method of marking an object which includes the steps of providing means for forming a spray of marking liquid, providing a stencil member adjacent the spraying means for receiving the spray of marking liquid, the stencil member having at least one opening therein forming at least one stencil character, positioning an object to be marked adjacent the stencil member, positioning the stencil member such that a stencil character is interposed between the spraying means and the object, spraying the marking liquid to form the spray to mark the object with a mark corresponding to the stencil character, periodically moving the stencil member for removal of marking liquid therefrom, and removing marking liquid from the periodically moved stencil member.

Apparatus in accordance with the invention comprises means for forming a spray of marking liquid, a stencil member positioned adjacent the spraying means for receiving the spray of marking fluid, the stencil member having at least one opening therein forming at least one stencil character, means for positioning an object to be marked adjacent the stencil member, means for positioning the stencil member such that a stencil character is interposed between the spraying means and the object, means for spraying the marking liquid to form the spray to mark the object with a mark corresponding to the stencil character, means for periodically moving the stencil member for removal of marking fluid therefrom, and means for removing marking fluid from the periodically moved stencil member.

DETAILED DESCRIPTION

There follows a detailed description of a preferred embodiment of the invention, together with accompanying drawings. However, it is to be understood that the detailed description and accompanying drawings are provided solely for the purpose of illustrating a preferred embodiment and that the invention is capable of numerous modifications and variations apparent to those skilled in the art without departing from the spirit and scope of the invention.

Figure 1:
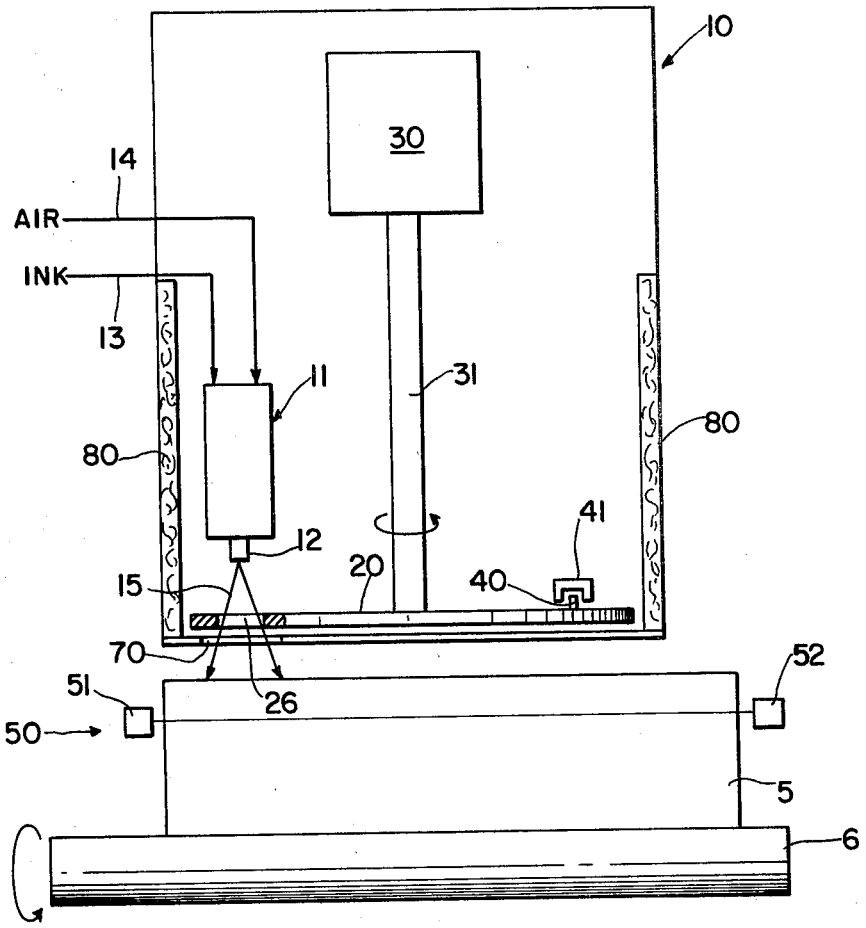
FIG. 1 is a diagrammatic end elevation view of an embodiment of the invention.
Figure 2:
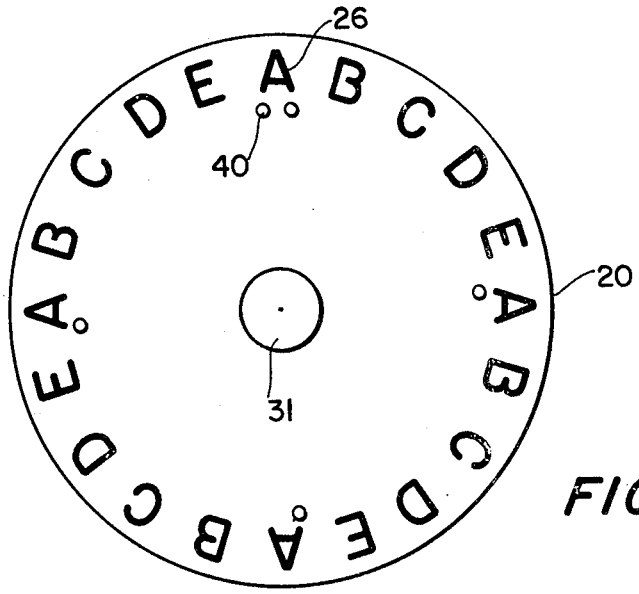
FIG. 2 is a plan view of a stencil mark member useful in the embodiment of FIG. 1.

With reference to FIG. 1, a part 5, for example, an automotive engine cylinder head, moving on roller conveyor 6, is to be marked with the correct code for the type of defects which it is known to contain. In the drawing, part 5 is assumed to be moving out of the plane of the drawing. The part is moving along the conveyor at a known rate "R." In the particular embodiment herein, a marking unit 10 according to the invention is provided having a conventional ink spraying means 11, comprising nozzle 12 for forming a spray of marking liquid. Ink or other marking liquid is supplied to the spraying device through conduit 13 and air for forming the spray is supplied through conduit 14. When the spraying device is actuated, the air forms a conventional spray 15 of the ink for marking part 5. Spray devices of this type are widely known and readily available. A rotating teflon or other non-stick coated aluminum stencil disc 20, typically ⅛ inch thick and 9 inches in diameter, and located ½ inch from the surface to be marked, is provided having stencil characters 26, cut through the disc around its periphery as shown in FIG. 2. In this example, there are five characters in four identical groups, or twenty characters total. In a typical operation, ink is supplied to the sprayer under a pressure of 3 psig and the ink spray is fired in a short burst, e.g. a 20 millisecond burst, to print a character. Atomizing air pressure is typically 5 psig. Conventional means are included in the spray device for controlling the operation of the sprayer.

A stepper motor 30 having shaft 31, is further provided to rotate stencil disc 20, in front of spray nozzle 12. In this example, the motor has a rating of 200 steps per revolution and 600 rpm maximum. Since there are only twenty characters on disc 20, a motor having a rating of only twenty steps per revolution would be suitable. However, motors having more steps per revolution are readily available and useful in the invention.

At the start of each group of characters is an indicator, in this case, post 40 sticking up from the disc which passes through optical switch 41. At the beginning of the disc, a double projection indicates the zero degree point. Any other suitable timing scheme can also be used.

By determining the starting points so provided using a conventional detector circuit and switch 41 and counting the pulses provided to said stepper motor using a counter, it is apparent that any character position on the disc can be located.

A part presence detector 50 is utilized to detect the presence of part 5 as the part moves into a position for marking. Any conventional detector can be used, but a non-contact detector, such as the optical device shown, is preferred. This device includes a light source 51 which directs light onto a light sensitive detector 52 which has an electrical output signal responsive to incident light. When part 5 moves into the position shown in FIG. 1, the part interrupts the light previously incident upon detector 52, thus changing the output signal from detector 52.

In the illustrated embodiment, there are any one of five code classes (A through E) to be marked on the part depending on the known characteristic of the part (such as a type of defect, absence of defect, part source, etc.). In an illustrative embodiment, in which a character "C" is to be marked on the part, a "C" marking command is fed to a conventional controller for the system which results in one of the four "C" characters on disc 20 being positioned in position to receive spray 15 of the marking liquid. Part presence sensor 50 is then utilized to actuate the ink spray to form the character "C" on part 5. A typical control sequence is as follows:

(a) command to mark "C" received;
(b) command to rotate motor 30 given;
(c) switch 41 signals start of a character group and activates a counter;
(d) motor 30 is stopped on indication from the counter that character C is in a position just ahead, in the sense of motion of part 5, of the location of spray 15;
(e) part presence indication received from light detector 52;
(f) motor 30 actuated to move disc 20 such that character C moves simultaneously with part 5 and at substantially the same linear speed as that of the moving part;
(g) spray command given to effect spray 15 when character C is moved into the spraying location adjacent nozzle 12.

A conventional microprocessor can be readily provided for these and other control functions applicable for rapid automatic operation of the present invention.

In the embodiment of FIG. 1, the part to be marked, i.e. cylinder head 5, is in motion and it is desirable not to stop it or contact it just for marking purposes if at all possible. Such non-contact, on the fly marking is possible using the invention by causing motor 30 to move disc 20 in the zone of the character selected at a peripheral rate approximately equal to the cylinder head speed during the period of marking, i.e., when the spray nozzle 12 is energized by a signal from a controller as described above.

As mentioned above, the spraying equipment may be conventional and various types of sprays can be used including area sprays which cover the entire area of the stencil character and sprays, such as fan sprays, which cover less than the entire stencil character area. Of course, in the latter case, it is necessary to move the stencil relative to the spray to make a mark corresponding to the stencil character. In the illustrated embodiment, this would be accomplished as the stencil is moved with the part during the spraying operation.

The number of different part codes that can be accommodated is a function of the peripheral size of the disc, the size of the characters, and the number of times the characters can repeat around the disc. For example, if no character is repeated, there would naturally be the maximum number of characters which one could pack on the disc.

The reason for rotating the mask at the rate of the part is that the burst of paint that can be fired through the mask may not sufficiently short to provide for an effective "stroboscopic" freezing of the part motion. In other words, even with a 20 millisecond ink burst, the part, which is preferably moving fairly rapidly, is travelling a fair distance in this time and one must keep the relative motion between the mark and part to a minimum in order to minimize spreading and blurring of the ink marks on the part surface.

Generally, the conveyor speed is fixed, and the motor speed to match the disc characters to this velocity can be pre-set. If the conveyor rate can change appreciably, such that characters would be undesirably blurred, an additional part present sensor similar to sensor 50 can be located upstream in the sense of part motion to generate a part velocity signal for the controller which can generate the correct matching disc motor speed. It is noted that for some cases a single speed can be used for both character selection and marking moving parts. However, other cases require a fast character select and a slower marking speed. Indeed, if character selection is fast enough, more than one mark can be applied to a part before it exists the marking station.

As can be seen from FIG. 1, the only ink or paint that can pass through the disc shaped stencil mask and out the marking exit hole 70 in housing 71 is the ink used to form the character. Therefore, a marker of this type is intrinsically free from the mess that plagues present marking systems.

One of the big questions, however, is what to do with the excess ink on the disc. In the disc of FIG. 1, the stepper motor used to position the disc is also used to remove ink by simply being speeded up to its highest rate, typically 600 rpm, which causes the ink to tend to fly off the disc. The disc is preferably provided with a non-stick surface, such as polytetrafluoroethylene to facilitate removal of the marking liquid. This spin cycle can be performed after every part that comes by if a sufficient time lapse occurs or after every 10 parts, etc., every shift or during periods of down time. A timer and/or marking cycle counter connected to an appropriate controller is readily utilized for this purpose.

The excess ink so spun off can be dealt with in several ways. As shown in FIG. 1, the ink may simply be absorbed by expendible blotting paper or other suitable absorbing material 80 located around the inner wall of the marker housing 71. The absorbing material is preferably provided as a readily replaceable unit such as a cartridge which is periodically replaced to maintain the absorbency. This is a very workable solution and both felt and paper are suitable. It should be noted that with good control of the ink spraying device, there is not too much excess ink per shot. In a properly designed system, removal of the blotter on a weekly basis may suffice.

Figure 3:
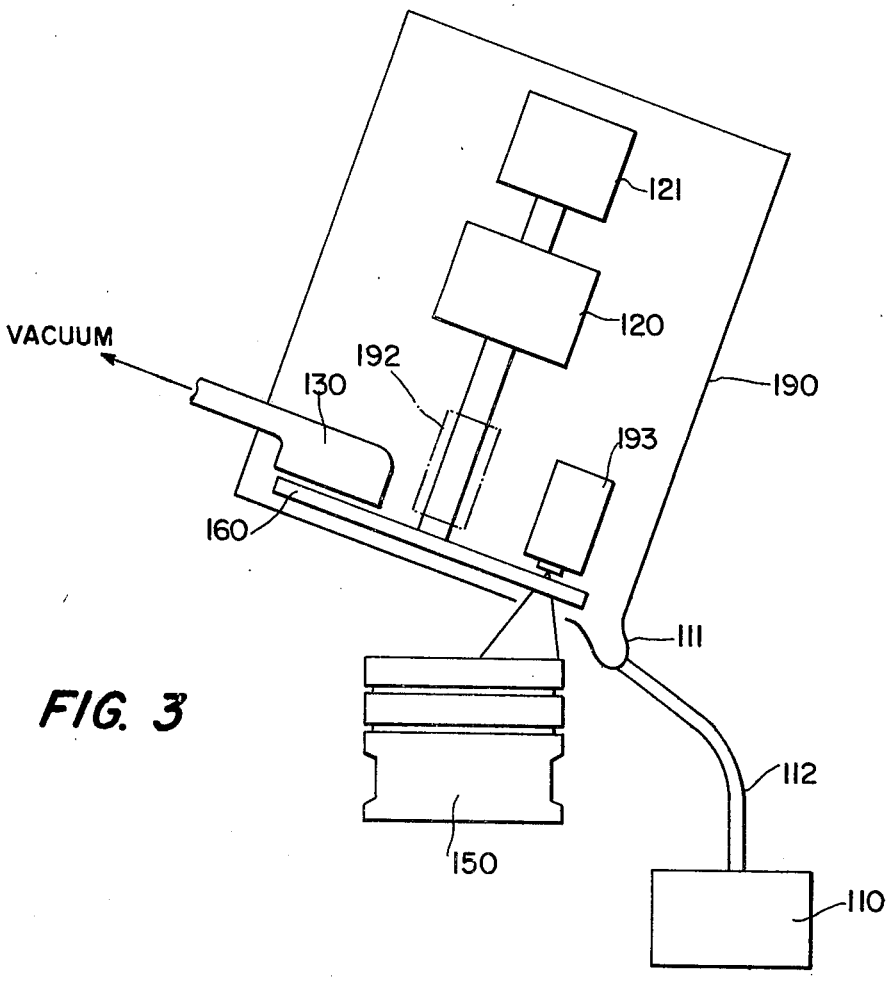
FIG. 3 is a diagrammatic side elevation view of an embodiment of the invention.
Figure 4:
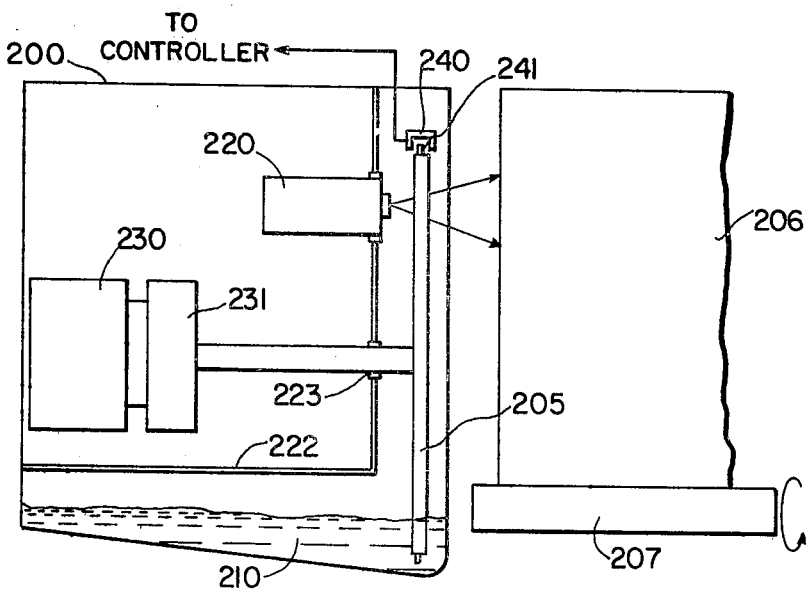
FIG. 4 is a diagrammatic side elevation view of an embodiment of the invention.

A second method, shown in FIG. 3, is to allow the ink to hit the outside wall of housing 190 and drip down into a trough 111 through conduit 112 and into drip tank 110. FIG. 4 also illustrates the use of a high speed (e.g. 3000 rpm) spin accomplished by a DC motor 120 used in conjunction with the mark position stepper motor 121. This is very useful if thicker pigmented inks or paints are utilized, and avoids undue loads on the stepper motor (albeit at extra cost).

In the case of the drip tank, the marker cannot get as close to the part 150 (a piston is illustrated in FIG. 4) as would otherwise be the case because of the presence of drip connections through 111 and 112. This can be a disadvantage since the closer to the part, the better the marks can be.

A third ink removal means is a vacuum manifold 130 shown in FIG. 3. In this case, the stencil just marked is rapidly indexed over to a separate removal station below manifold 130 where the excess is then sucked off. This sucking process can be in addition to, or in place of, the spin cycle noted above.

Particularly where the spin cycle is performed only periodically and not every cycle, it is generally desirable to employ a cleaning liquid to facilitate the removal of marking liquid. The ink itself may be used as the cleaning medium. This, of course, works best if the ink has a high percentage of solvent in it and furthermore if the solvent is relatively long drying, such that the ink is not totally dried on the surface of the mask at the time in which the spinning is effected. In this manner, the ink cleaning cycle need only occur once or twice a day, for example, even when the unit is in continuous use, for example, one shot every ten seconds.

Further with reference to FIG. 3, it is noted that the invention here disclosed can mark static parts, such as piston 150 shown. In this case there is no need to match the speed of the part and mask 160 is simply stopped when the correct character is in position. As soon as the marking is complete and a new mark value is given to the controller, the mask disc is rotated to the new position where it awaits the next part.

The housing 190 of FIG. 3 has been located at a slight angle to allow for gravity to provide drip collection at the low end; and in this case, it is desirable to use a substantially cylindrical housing 190 such that essentially one drip collection point results. A cylindrical housing is also of use in the embodiment of FIG. 1 since it allows an easily replaceable cylindrical blotter cartridge to be used; the character disc is preferably circularly symmetric.

Another variation rather than the simple expedient of spraying some of the ink is to actually have a separate solvent spray head 192 shown in dotted lines in FIG. 3 located 90° with respect to ink spray head 193. This naturally requires more tanks, etc., but can be desirable if heavily pigmented and quick drying inks or paints are utilized. This is often the case if a light color such as white or yellow is to be used.

FIG. 4 illustrates another embodiment of the invention. In this embodiment, the marking spray head 220, with stencil mask 205 is used to mark part 206 on conveyor 207. The unit is mounted to spray in the horizontal or nearly horizontal direction rather than the vertical or angles plane as in the units of FIGS. 1 and 3 above. While those units can operate in this orientation as well, the unit 200 shown here illustrates another mask cleaning approach possible in this spray attitude. In this case, a solvent bath 210 is maintained through which the disc 205 rotates. The housing 200 does not have to be exactly located as shown and can be oriented at any angle such that the disc can be sufficiently immersed to allow cleaning of the characters.

In a version of this embodiment, the mark is sprayed using the spray gun 220 located at the top or possibly at the sides. Immediately thereafter the disc is rotated through the solvent bath to clean it and no further cleaning is usually necessary. If desired, an additional vacuum line or air blow can be utilized to clean the solvent off the disc, as in FIG. 3 above. Note the use of partition 222 with seal 223 to shield motor and shaft 224 and other electricals from the solvent.

It is noted that this invention is not limited to the use of stepper motors for mask position. Any suitable means can be used including DC motors and brakes with encoded mask positions. In this case, a series of slots for example around the periphery of the mask can be used to furnish count pulses indicative of character position, rather than the use of stepper motor.

Figure 5:
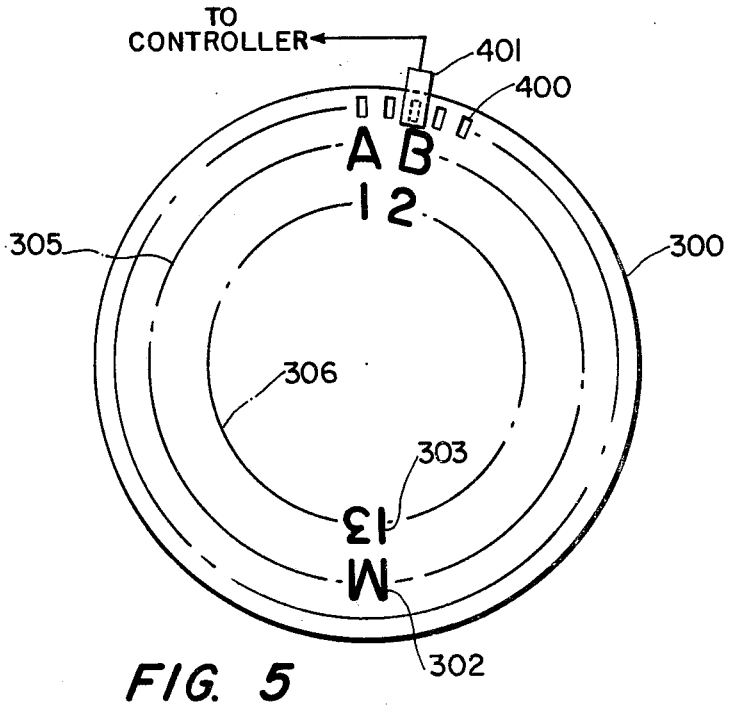
FIG. 5 is a diagrammatic plan view of a stencil mark member.

Such a system is shown in FIG. 4 where DC motor 230 and electrically actuated brake 231 are used combined with optical switch 240 looking through coded holes 241 in the character disc periphery (see FIG. 5 as an example of the coded holes).

Another embodiment of the stencil mask is shown in FIG. 5, in which a dual character disc 300 is utilized. In this case, two marking guns (not shown) would be utilized, whose spray patterns are 302 and 303, one for each ring of characters, the outer ring 305 and the inner 306, respectively. This arrangement allows more characters to be marked. Both guns however, can be driven from the same ink supply system with just a selection by the controller of which one is to fire at which point, determined in this case by the encoding slots 400 around the periphery read by optical switch 401. Additional rings of characters can also be employed.

It should be noted that the marking device described above generally marks all parts with at least one mark. For example, good parts can get the mark "OK," whereas the rejects can get a different mark, but all parts get a mark. This means that the ink or paint spray gun is exercised each cycle and this precludes clogging of the ink guns.

Figure 6:
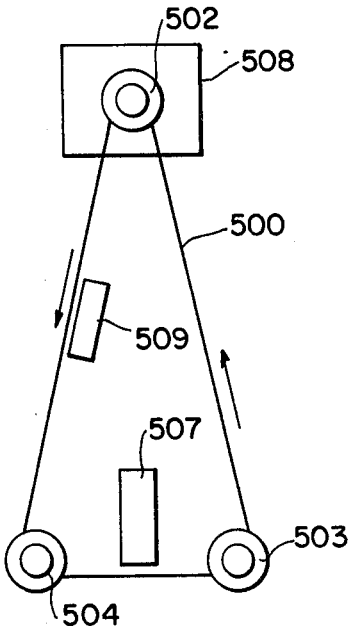
FIG. 6 is a diagrammatic end elevation view of an embodiment of the invention.
Figure 7:
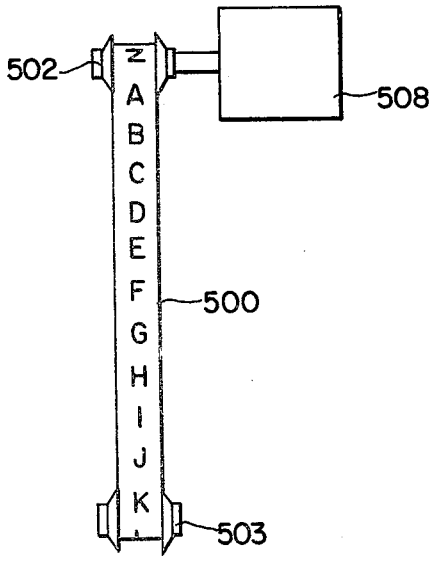
FIG. 7 is a diagrammatic side elevation view of the embodiment of FIG. 6.

Another variation on the marking system is shown in FIGS. 6 and 7. In this embodiment, a moving strip 500 of characters wrapped around pulleys 502–504 is utilized, together with nozzle 507, motor 508 and other items similar to FIGS. 1–5 above. This particular version has some advantages, namely that many more characters can be written generally within the restriction of a given sized housing since length (or height) is traded for width. Usually, substantial mounting length is available in a manufacturing location whereas width (that is, extension in the part motion or line direction) is not.

The second advantage of the moving strip version is that when dual heads such as FIG. 5 above are utilized, they all can be side by side and mark the same number of characters where decreasing radius problems obviously exist in the disc version. A suction device 509 is provided to remove excess marking liquid.

Uses of the above invention extend to all areas of modern manufacturing and may include marking of reject codes, size classes, build codes, date codes, shift codes, machine codes, etc. Parts which can be marked include high cost parts such as engine components, car doors, etc. Boxes, containers, and packaging materials of all kinds may also be marked using the invention, as can virtually anything else that can be brought close enough to the marking unit such that a legible mark is produced.

It is further noted that the unit can be used to spray a grid pattern on mating parts which acts to further allow verification of their mated condition at some future point in a process. In this case, the mask characters are horizontal parallel lines at different orientations randomly selected (via a random number generator or sequence in the controller).

It is noted that the invention works better the closer one is to the part and mask to part distances of ½ inch have proved desirable although 1 inch still produces reasonably legible characters. Legibility as a function of distance is dependent on character size and type as well.

What is claimed is:

1. A method of marking an object comprising:

(a) providing means for forming a spray of marking liquid;

(b) providing a rotatable stencil member adjacent said spraying means for receiving said spray of marking liquid, said stencil member having at least one opening therein forming at least one stencil character;

(c) positioning an object to be marked adjacent said stencil member;

(d) positioning said stencil member such that a stencil character is interposed between said spraying means and said object;

(e) spraying said marking liquid to form said spray to mark the object with a mark corresponding to said stencil character; and (f) periodically rotating said stencil member sufficiently rapidly to effect removal of marking liquid therefrom by centrifugal force.

2. A method according to claim 1 wherein a cleaning liquid is applied onto said stencil member to facilitate removal of said marking liquid.

3. A method according to claim 2 wherein said cleaning liquid comprises marking fluid.

4. A method according to claim 1 further including the step of collecting the removed marking liquid.

5. A method according to claim 1 wherein the removed marking liquid is collected in an absorbent member positioned about the periphery of said stencil member.

6. A method according to claim 1 wherein said object is moved during step (e) and wherein said stencil member is simultaneously moved therewith to facilitate marking said object.

7. Apparatus for marking objects comprising:

(a) means for forming a spray of marking liquid;

(b) a rotatable stencil member positioned adjacent said spraying means for receiving said spray of marking fluid, said stencil member having at least one opening therein forming at least one stencil character;

(c) means for positioning an object to be marked adjacent said stencil member;

(d) means for positioning said stencil member such that a stencil character is interposed between said spraying means and said object;

(e) means for spraying said marking liquid to form said spray to mark the object with a mark corresponding to said stencil character; and (f) means for periodically rotating said stencil member sufficiently rapidly to effect removal of marking fluid therefrom by centrifugal force.

8. Apparatus according to claim 1 further comprising means for collecting removed marking liquid.

9. Apparatus according to claim 8 further comprising an absorbent member positioned about the periphery of said rotatable stencil member for collecting removed marking liquid.

10. Apparatus according to claim 7 further comprising means for moving said object and means for simultaneously moving said stencil member therewith to facilitate marking said object.

11. A method of marking an object comprising (a) providing means for forming a spray of marking liquid;

(b) providing a stencil member adjacent said spraying means for receiving said spray of marking liquid, said stencil member having at least one opening therein forming at least one stencil character;

(c) positioning an object to be marked adjacent said stencil member;

(d) positioning said stencil member such that a stencil character is interposed between said spraying means and said object;

(e) spraying said marking liquid to form said spray to mark the object with a mark corresponding to said stencil character;

(f) periodically moving said stencil member for removal of marking liquid therefrom; and (g) applying a cleaning liquid to said periodically moved stencil member to remove marking liquid therefrom, said cleaning fluid comprising said marking liquid.

12. Apparatus for marking objects comprising:

(a) means for forming a spray of marking liquid;

(b) a stencil member positioned adjacent said spraying means for receiving said spray of marking lfuid, said stencil member having at least one opening therein forming at least one stencil character;

(c) means for positioning an object to be marked adjacent said stencil member;

(d) means for positioning said stencil member such that a stencil character is interposed between said spraying means and said object;

(e) means for spraying said marking liquid to form said spray to mark the object with a mark corresponding to said stencil character;

(f) means for periodically moving said stencil member for removal of marking fluid therefrom;

(g) means for applying a cleaning liquid to said periodically moved stencil member for removing marking liquid therefrom, said cleaning liquid comprising said marking liquid; and (h) means for supplying marking fluid from a common supply to said spray forming means and to said cleaning liquid applying means.

13. A method of marking an object comprising:

(a) providing means for forming a spray of marking liquid;

(b) providing a rotatable stencil member adjacent said spraying means for receiving said spray of marking liquid, said stencil member having at least one opening therein forming at least one stencil character;

(c) positioning an object to be marked adjacent said stencil member;

(d) automatically rotating said stencil member such that a stencil character is interposed between said spraying means and said object;

(e) spraying said marking liquid substantially horizontally to form said spray to mark the object with a mark corresponding to said stencil character;

(f) periodically rotating said stencil member such that a portion thereof bearing marking liquid is moved through a body of cleaning liquid at a marking liquid removal location for removal of marking liquid therefrom; and (g) minimizing relative motion of said object and stencil member during step (e).

14. Apparatus for marking objects comprising:

(a) means for forming a spray of marking liquid;

(b) a rotatable stencil member positioned adjacent said spraying means for receiving said spray of marking fluid, said stencil member having at least one opening therein forming at least one stencil character;

(c) means for positioning an object to be marked adjacent said stencil member;

(d) means for automatically rotating said stencil member such that a stencil character is interposed between said spraying means and said object;

(e) means for spraying said marking liquid substantially horizontally to form said spray to mark the object with a mark corresponding to said stencil character;

(f) means for periodically rotating said stencil member such that a portion thereof bearing marking liquid is moved through a body of cleaning liquid at a marking liquid removal location for removal of marking liquid therefrom; and (g) means for minimizing relative motion of said object and stencil member during step (e).

* * * * *